United States Patent [19]

Marsh

[11] 4,385,576

[45] May 31, 1983

[54] PRESSER FOOT AND SHANK DESIGN (SNAP-ON)

[75] Inventor: Walter H. W. Marsh, Scotch Plains, N.J.

[73] Assignee: The Singer Company, Stamford, Conn.

[21] Appl. No.: 319,169

[22] Filed: Nov. 9, 1981

[51] Int. Cl.[3] ..... D05B 29/00

[52] U.S. Cl. ..... 112/240; 16/257

[58] Field of Search ..... 16/224, 257, 259, 260, 16/262, 266; 403/157, 159; 112/240

[56] References Cited

U.S. PATENT DOCUMENTS

| | | | |
|---|---|---|---|
| 126,220 | 4/1872 | Loucks | 403/159 |
| 918,225 | 4/1909 | Townley | 403/159 |
| 2,811,768 | 11/1957 | Axelson | 16/257 X |
| 2,814,266 | 11/1957 | Marshall . | |
| 3,087,192 | 4/1963 | Hertzke | 16/257 |
| 3,936,907 | 2/1976 | Jansons | 16/257 |
| 4,213,411 | 7/1980 | Knowles | 112/240 |

FOREIGN PATENT DOCUMENTS

| | | |
|---|---|---|
| 37-568074 | 4/1962 | Japan . |
| 38-772497 | 8/1963 | Japan . |
| 40-596 | 4/1965 | Japan . |
| 43-10131 | 1/1968 | Japan . |

*Primary Examiner*—Werner H. Schroeder
*Assistant Examiner*—Andrew M. Falik
*Attorney, Agent, or Firm*—William V. Ebs; Robert E. Smith; Edward L. Bell

[57] ABSTRACT

A presser foot for a sewing machine is formed of plastic with upstanding spreadable legs including protuberances which snap into countersunk portions of a through hole in a shank to provide a pivotal mounting for the foot on the shank in the machine.

3 Claims, 6 Drawing Figures

PRESSER FOOT AND SHANK DESIGN (SNAP-ON)

BACKGROUND OF THE INVENTION

1. Field of the Invention

The invention relates to presser feet for sewing machines, and more particularly to the means for attaching a presser foot to a presser bar shank in a machine.

2. Description of the Prior Art

Various means have been employed to provide for the attachment of a foot to a presser bar shank in a sewing machine. However, such means have generally required that the foot and shank be fashioned in a manner resulting either in rather costly structures, or an unsatisfactory assembly in terms of its ability to reliably perform the intended function.

It is a prime object of the present invention to provide an improved arrangement for a presser foot and shank assembly in a sewing machine enabling the parts to be easily and inexpensively manufactured, and facilitating attachment of the foot to the shank.

It is another object of the invention to provide an improved presser foot and shank assembly in which the foot is supported against the shank and can roll thereon during sewing operations.

It is still another object of the invention to provide an improved presser foot and shank assembly in which the shank, by acting against the foot, cams the foot out of engagement with the shank when the foot is pivoted beyond a predetermined angular position on the shank.

Other objects and advantages of the invention will become apparent during a reading of the specification taken in connection with the accompanying drawings.

SUMMARY OF THE INVENTION

In accordance with the invention, there is provided a plastic presser foot with spreadable upstanding legs, and a shank to enter therebetween while forcing the legs slightly apart. The legs and shank are formed with protuberances and recesses which are mutually engaged in a predetermined relative position of the shank and foot to establish a pivotal axis for the foot on the shank in a sewing machine. The shank has a contoured bottom end surface to contact a portion of the foot between said legs and provide a supportive surface upon which the foot can roll during sewing operations on the machine. Such shank end surface is dimensioned to cam the foot out of engagement with the shank when the foot is pivoted beyond a predetermined angular position on the shank.

DESCRIPTION OF THE PREFERRED EMBODIMENT

Figure 1:
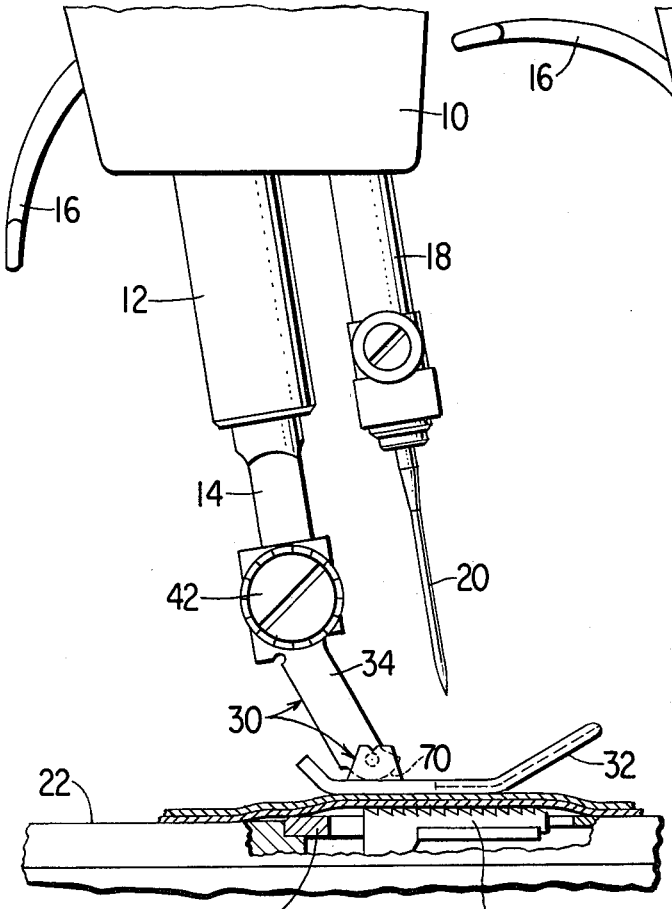
FIG. 1 is a side elevational view of a fragment of a sewing machine showing a presser foot and shank assembly according to the invention on a lowered presser bar.
Figure 2:
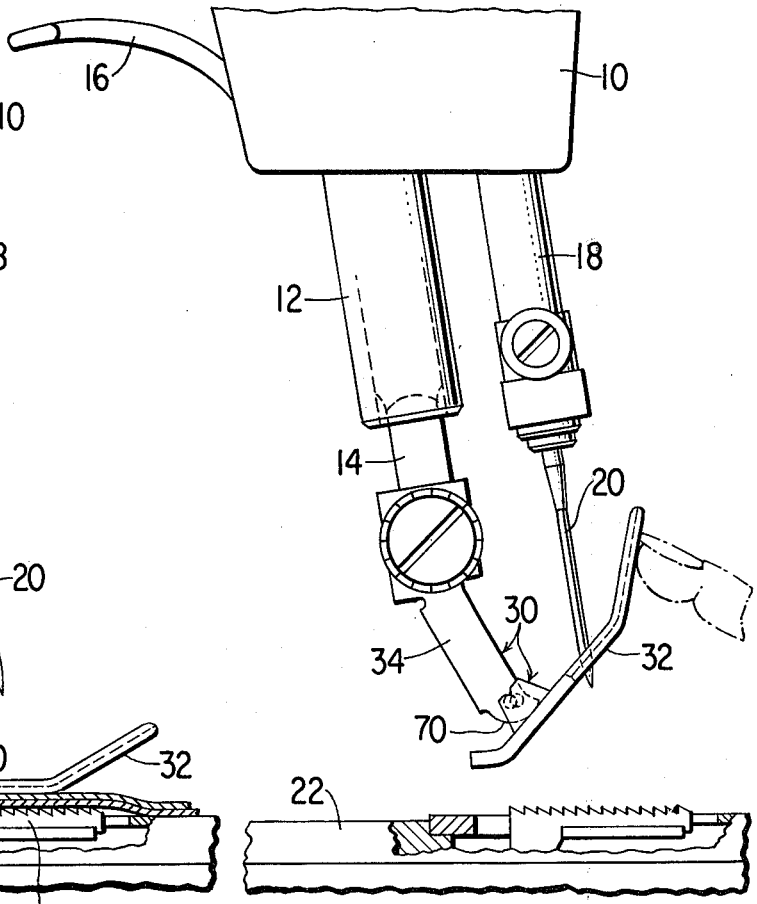
FIG. 2 is a view similar to FIG. 1 with the presser bar in a released position and presser foot and shank assembly in the process of being disassembled.
Figure 3:
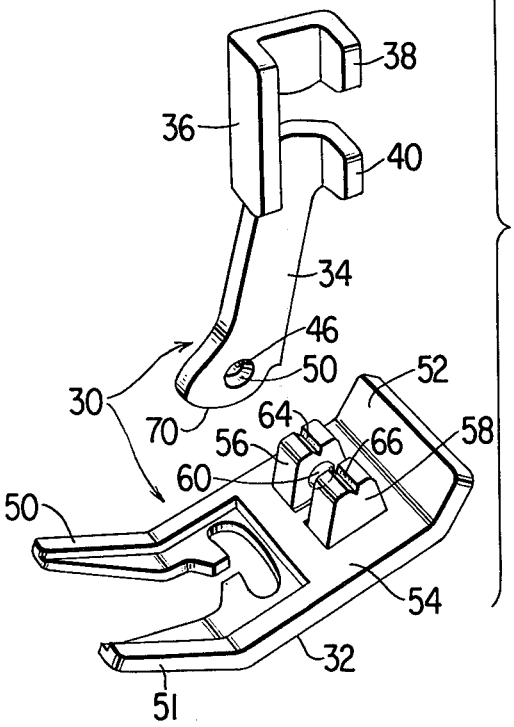
FIG. 3 is an enlarged disassembled perspective view showing the construction of the invention.
Figure 4:
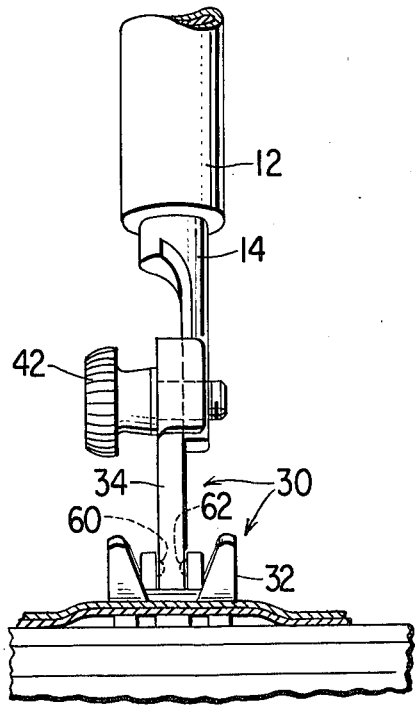
FIG. 4 is a front elevational view showing the presser foot and shank assembly of the invention.

Referring to the drawings, reference character 10 designates the head end portion of a sewing machine bracket arm. A bushing 12 is secured in head end portion 10 and a presser bar 14 is slidable endwise in the bushing. The presser bar, as is conventional, is provided with a spring (not shown) to bias it downwardly. However, the presser bar may be raised and lowered at will by a presser lifting lever 16 carried in the bracket arm. A needle bar 18 carrying a needle 20 for the formation of stitches, is endwise reciprocable in the bracket arm. The sewing machine frame includes a work supporting bed 22 beneath the bracket arm. The bed carries a throat plate 24 that is formed with slots through which a feed dog 28 of a conventional sewing machine feed mechanism is operative. Carried on the presser bar above the feed dog is the assembly 30 of the invention including a presser foot 32 and shank 34.

Shank 34 is preferably a metal part formed at the top with a U-shaped presser bar accommodating seat defined at one side by an outturned tab 36 and at the other side by outturned bifurcations 38 and 40. The presser foot shank is secured to the presser bar by means of a shouldered clamp screw 42 which passes between the bifurcations and is threaded into the presser bar 14. As shown, shank 34 is provided with a through hole 46 including countersunk recesses 48 and 50 in opposite side surfaces of the shank.

Presser foot 32 is a plastic part which includes the end portions 50 and 51, a heel end portion 52, and a flat plate portion 54 with upstanding spreadable legs 56 and 58. Protuberances 60 and 62 are formed on the inside surfaces of legs 56 and 58, respectively. Such protuberances 60 and 62 are receivable in the countersunk leg recesses 48 and 50, respectively. The entire presser foot 32 including legs 56 and 58 with the protuberances 60 and 62 is conveniently produced as a one piece molded part.

Figure 5:
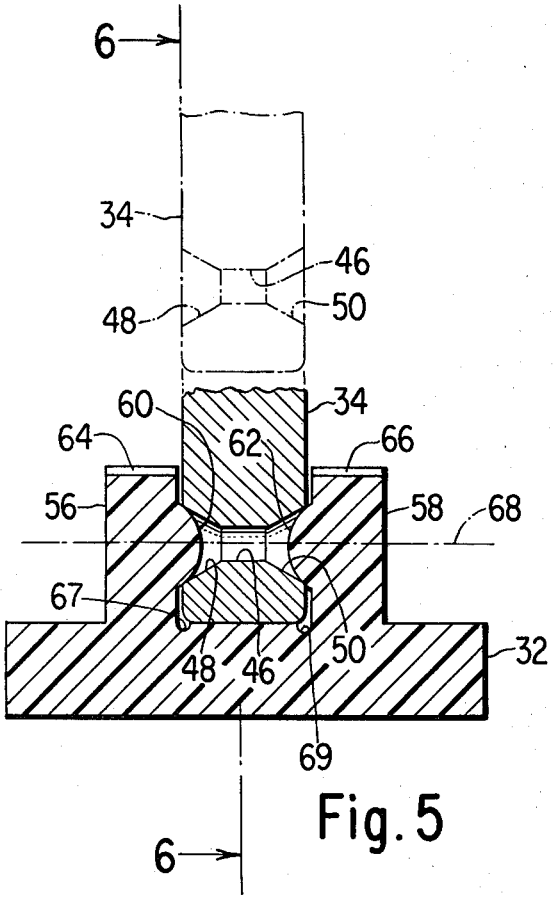
FIG. 5 is an enlarged fragmentary vertical sectional view showing the presser foot and shank both in an assembled and disassembled condition.

The presser foot 32 and shank 34 are assembled with the presser bar 14 and shank 34 attached thereto initially in a raised position as determined by the operation of presser bar lifting lever 16. The presser foot is first moved into a position where the space between the legs 56 and 58 of the foot is directly below the lower end of shank 34 and the protuberances 60 and 62 are at least substantially in alignment with countersunk recesses 48 and 50, respectively, in shank 34, alignment of the protuberances and recesses being facilitated by readily viewable V-shaped notches 64 and 66 which are provided in the top surfaces of the legs in a plane extending through the protuberances in a direction perpendicular to the flat plate portion 54 of the foot. The shank 34 is then caused to move downwardly by the lowering of lever 16, and is finally forced by downward pressure on clamp screw 42 into a position wherein the protuberances 60 and 62 snap into recesses 48 and 50 to provide a pivotal mounting for the foot on the shank about an axis 68 extending through the protuberances and perpendicular to the upstanding legs. The fit between the protuberances and recesses is such as to permit the foot to pivot freely on shank 34 and yet maintain the foot thereon during normal usage. As may be seen in FIG. 5, the presser foot 32 includes stress relieving channels 67 and 69 at the base of legs 56 and 58. Such channels enhance the springyness of the legs to facilitate assembly and disassembly of the foot and shank, and in addition, prevent stress cracking of the foot. The channels, although shown only at the inside of legs 56 and 58 may also be provided at the outside ends.

Figure 6:
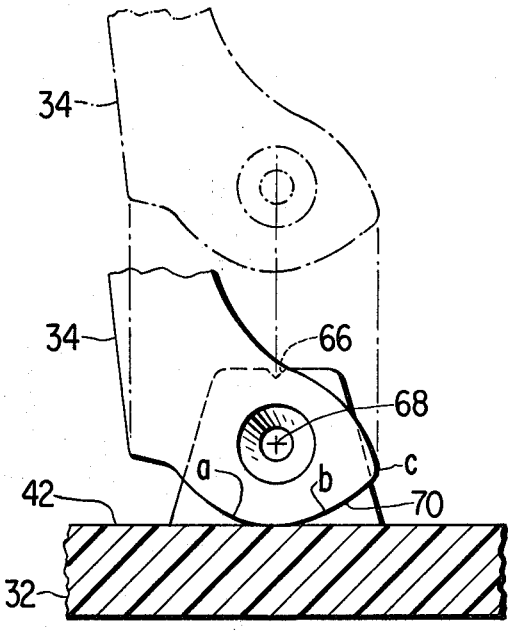
FIG. 6 is a view taken on the plane of the line 6—6 of FIG. 5.

As shown, the bottom end of shank 34 is formed with a curved surface 70. Such curved surface (see FIG. 6) extends for a portion of its length (a to b) from axis 68 at a radius such as to provide a supportive surface upon which the flat plate portion 54 of foot 32 between legs 56 and 58 can roll to permit adjustment of the foot about pivotal axis 68 as required for the foot to be flush against a fabric under it during sewing operations. Surface 70 extends toward the front of shank 34, from b to c, at an increasing distance from axis 68 such as to cause surface b-c to exert a camming action on flat plate portion 54 of foot 32 when the foot is rocked by an operator toward the front of the shank 34, and results in the protuberances 60 and 62 being dislodged from recesses 48 and 50 thereby permitting the foot to be detached from shank 34.

It is to be understood that the present disclosure relates to a preferred embodiment of the invention which has been presented for purposes of illustration only, and that various modifications may be made therein without departing from the spirit and scope of the invention as defined in the appended claims. It is, for example, well within the scope of the invention to reverse the locations of the protuberances and recesses shown on the shank and foot respectively, that is by having the protuberances on the shank instead of on the legs of the foot, and having the recesses on the legs instead of on the shank. It is also within the scope of the invention to provide a rearwardly extending camming surface on the bottom of the shank in place of or in addition to the forward extending camming surface to enable the foot to be removed from the shank by the foot being rocked toward the rear of the shank.

I claim:

1. In combination, a plastic presser foot with a pair of upstanding spreadable legs, and a shank to enter therebetween while forcing the legs apart, said legs and shank being formed with protuberances and recesses which mutually engage in a predetermined relative position of the shank and foot to establish a pivotal axis for the foot on the shank in a sewing machine, the shank including a bottom contoured end surface to contact a portion of the foot between said legs and provide a surface upon which the foot can roll during sewing operations on the machine.

2. The combination of claim 1 wherein the bottom contoured end surface of the shank is dimensioned to cam the foot out of engagement with the shank at the said protuberances and recesses when the foot is pivoted beyond a predetermined angular position on the shank.

3. In combination, a plastic presser foot with a pair of upstanding spreadable legs, and a shank to enter therebetween while forcing the legs apart, said legs and shank being formed with protuberances and recesses which mutually engage in a predetermined relative position of the shank and foot to establish a pivotal axis for the foot on the shank in a sewing machine, the foot including a channel at the base of each of the legs.

* * * * *